US006037730A

United States Patent [19]

Turner et al.

[11] Patent Number: 6,037,730

[45] Date of Patent: Mar. 14, 2000

[54] DEGRADED ELECTRONIC THROTTLE OPERATION METHOD AND SYSTEM

[75] Inventors: David Turner, Bloomfield Hills, Mich.; Mark G. Solveson, Oconomowoc, Wis.

[73] Assignee: Eaton Corporation, Cleveland, Ohio

[21] Appl. No.: 09/190,520

[22] Filed: Nov. 12, 1998

[51] Int. Cl.[7] ..... F02D 11/10

[52] U.S. Cl. ..... 318/432; 318/632; 318/640; 123/396; 123/399

[58] Field of Search ..... 318/432, 139, 318/632, 434, 640; 123/198 F, 399, 361, 396, 403, 400; 251/129.11; 310/156, 268; 180/178

[56] References Cited

U.S. PATENT DOCUMENTS

| | | | |
|---|---|---|---|
| 4,995,363 | 2/1991 | Terazawa et al. | 123/399 |
| 5,048,484 | 9/1991 | Terazawa et al. | 123/361 |
| 5,048,485 | 9/1991 | Terazawa et al. | 123/399 |
| 5,163,402 | 11/1992 | Taguchi et al. | 123/396 |
| 5,267,541 | 12/1993 | Taguchi et al. | 123/198 F |
| 5,429,090 | 7/1995 | Kotchi et al. | 123/396 |
| 5,823,165 | 10/1998 | Sato et al. | 123/399 |

*Primary Examiner*—Paul Ip
*Attorney, Agent, or Firm*—Fay, Sharpe, Fagan, Minnich & McKee, LLP

[57] ABSTRACT

An electronic throttle assembly uses a torque motor and mechanical system to position the throttle. The assembly is configured to keep the throttle slightly open during times of electrical power failure to the torque motor. Inherent electromagnetic qualities of the torque motor provide a reluctance torque that varies depending on internal stator/rotor geometry and is present in the absence of electrical power to the motor. A mechanical system provides a counter torque. Aligning the throttle to the desired slightly open position at a point where the reluctance torque is countered by the mechanical torque, allows an engine controlled by the throttle to continue to operate even if electrical power to the torque motor is lost.

9 Claims, 2 Drawing Sheets

DEGRADED ELECTRONIC THROTTLE OPERATION METHOD AND SYSTEM

BACKGROUND OF THE INVENTION

The present invention relates to torque motors. Motors of this type typically provide angular displacement or movement of a rotor by an amount proportional to the characteristics of an electrical signal applied to the windings of the motor. For example, angular movement can be proportional to the voltage applied to the motor winding.

Torque motors have found widespread application in various control systems. In these systems it is desirable to rotate a shaft to a specific position or to apply a specified amount of torque to a shaft in response to an electrical control signal. In one particular system, it has been desirable to utilize a torque motor to control the position of a throttle plate within an internal combustion engine. One such system is described in Ser. No. 09/076,352, filed May 12, 1998, now U.S. Pat. No. 5,912,538, assigned to the assignee of this disclosure and incorporated here by reference is directed to breaking ice within a throttle assembly after a period of non-use. Another such system controls the position of the air inlet throttle valve by an electrical signal during engine operation.

With regard to controlling throttle plate position in an operating engine, older systems were directly mechanically controlled by user movement of a throttle linkage attached to the throttle valve. On the other hand, electrical throttle valve control is especially desirable in certain motor vehicle applications such as to provide cruise control and/or to override the user input to the throttle position control mechanism in response to extreme driving conditions or emergency situations. For example, where an anti-lock brake system, traction control system or yaw rate control system is employed on the vehicle, it is desired under certain conditions to have the electronic control system determine the throttle position rather than the operator.

A drawback exists however with respect to electrically controlled throttle systems. Namely, if the vehicle electrical system fails, or if electrical power to the throttle motor is interrupted, the electrical signal controlling the vehicle throttle position vanishes causing the throttle valve to "float." It has been appreciated in the art that a floating throttle may open further thus accelerating a vehicle unexpectedly or dangerously. In recognition of this danger, throttle control systems typically include springs to close a throttle valve in the absence of opening torque provided by the throttle controller mechanism or motor. However, this spring closure feature results in sharply diminished airflow to the vehicle motor causing the vehicle to slow and eventually to stop, perhaps in traffic, again potentially placing the occupants and nearby vehicles in danger.

The present invention contemplates a new, safer electronic throttle and method of use, which overcomes the above referenced problems and others.

BRIEF SUMMARY OF THE INVENTION

In accordance with the present invention, a method of ensuring continued airflow to an engine controlled by an electronic throttle system during a time of electrical power loss is provided. The method includes the steps of positioning a throttle plate within an air/fuel intake manifold such that the throttle plate is movable between an open position allowing airflow through the manifold and a closed position substantially blocking airflow. Also included is the application of a first torque to the throttle plate to urge the throttle plate toward the open position and application of a second torque urging the throttle plate toward the closed position. The first and second torques counteract each other so that the throttle plate remains at a position between the open and closed positions to allow airflow through the manifold.

In accordance with another aspect of the present invention, the first torque is provided by the electromagnetic properties of a torque motor and the second torque is provided by a return spring.

In accordance with a more limited aspect of the present invention, the method further includes determining a reluctance torque curve by plotting a specific reluctance torque value for a range of positions of the throttle plate. Then the throttle plate is aligned such that the reluctance torque value for a desired position cancels the closing bias at the desired position. At this desired position, the throttle plate is sufficiently open to provide airflow through the manifold to the engine.

In accordance with an additional aspect of the present invention, a method of configuring an electronic throttle assembly to operate in a degraded mode without electrical power is provided. An opening torque is applied to a throttle plate tending to urge the throttle plate to an open position, allowing airflow through a manifold.

Simultaneously, a closing torque is applied to the throttle plate tending to urge the throttle plate to a closed position. The simultaneous, opposite torque applications leave the throttle plate in a neutral, slightly open position.

In accordance with another aspect of the present invention, opening torque is applied by steps including connecting the throttle plate to a rotating portion of an electromagnetic torque motor. The torque motor defines a plurality of reluctance torque values based on the position of the rotating portion. The throttle plate is placed in an offset position allowing the reluctance torque to provide the opening torque.

In accordance with another aspect of the present invention, an electronic throttle includes a throttle plate movably disposed within an air/fuel intake manifold. The throttle plate travels between a first position substantially blocking airflow and a second position substantially permitting airflow. A torque motor defines a variable first torque which urges the throttle plate toward the second position when no current passes through the windings of the motor. Oppositely, a means for providing a second torque that tends to urge the throttle plate toward the first position is also included. A shaft is also included in operative connection between the torque motor and the throttle plate. The shaft is angularly aligned such that the throttle plate rests in an equilibrium position between the first and second positions.

In accordance with a more limited aspect of the present invention, the variable first torque is produced by electromagnetic properties of the torque motor.

In accordance with a more limited aspect of the present invention, the means for providing the second torque is a return spring.

One advantage of the present invention resides in the provision of a method which ensures continued airflow to an engine during periods of power failure.

Another advantage of the present invention is the provision of a method which configures an electronic throttle assembly in a way to allow degraded operation in the absence of electrical power.

Other benefits and advantages of the present invention will become apparent to those skilled in the art upon a reading and understanding of the detailed description of the preferred embodiments.

BRIEF DESCRIPTION OF THE DRAWINGS

The invention may take form in certain parts and arrangements of parts, and in certain steps and arrangements of steps, preferred embodiments of which are illustrated herein. The drawings are only for purposes of illustrating preferred embodiments and are not to be construed as limiting the invention.

DETAILED DESCRIPTION OF THE INVENTION

Figure 1:
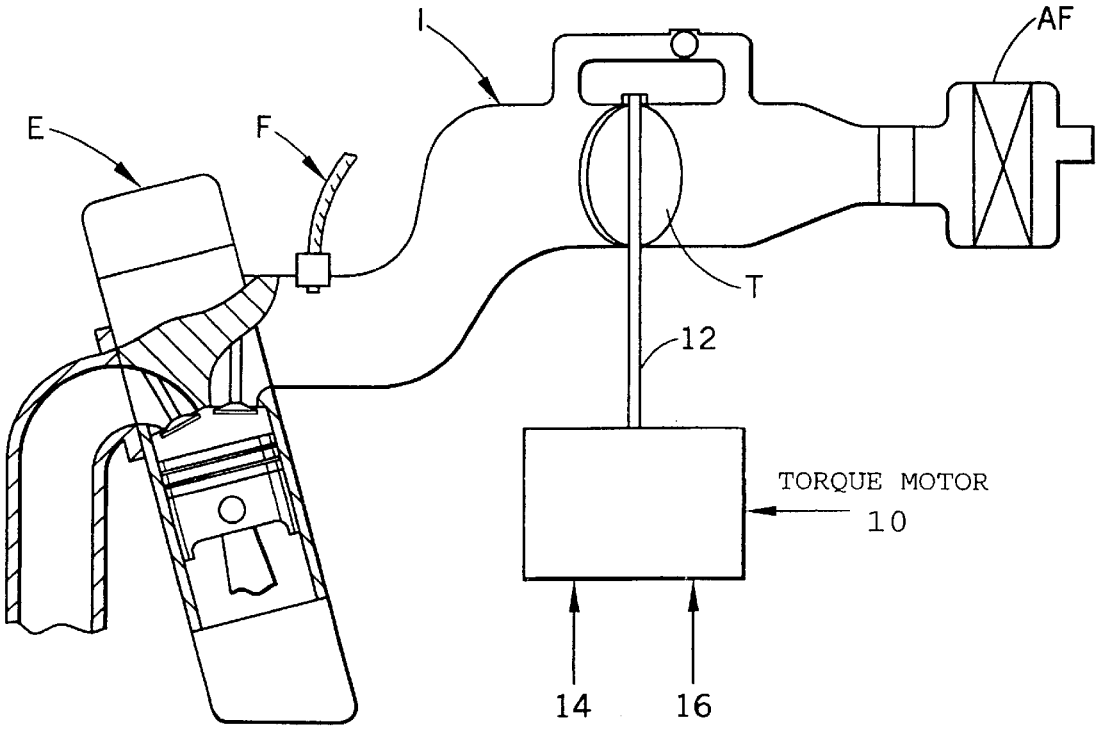
FIG. 1 is a simplified diagrammatic illustration of a motor vehicle internal combustion engine air intake system and associated electronic throttle control system.

Referring to FIG. 1 a simplified internal combustion engine includes an air/fuel intake manifold I. Air enters the manifold I through an air filter AF. The flow of air into and through the manifold I is controlled by a throttle plate valve T. The throttle plate valve T selectively blocks air flow in one position or is rotated a varying amount allowing a select airflow to pass into the internal combustion engine E. A fuel injector F selectively injects gasoline or other fuel into the air stream for combustion in the engine E.

The angular position of the throttle plate T is controlled by the torque motor 10. More particularly, the output shaft 12 of the motor 10 is connected with the throttle plate T so that the plate rotates at the urging of the motor 10. The torque motor 10 receives electrical power 14 and command signals 16. Those of ordinary skill in the art will recognize that if power 14 is lost to the torque motor 10, operator desired positioning of throttle plate T is lost. Thus, an operator of a vehicle will be unable to control the speed of the internal combustion engine E.

Figure 2:
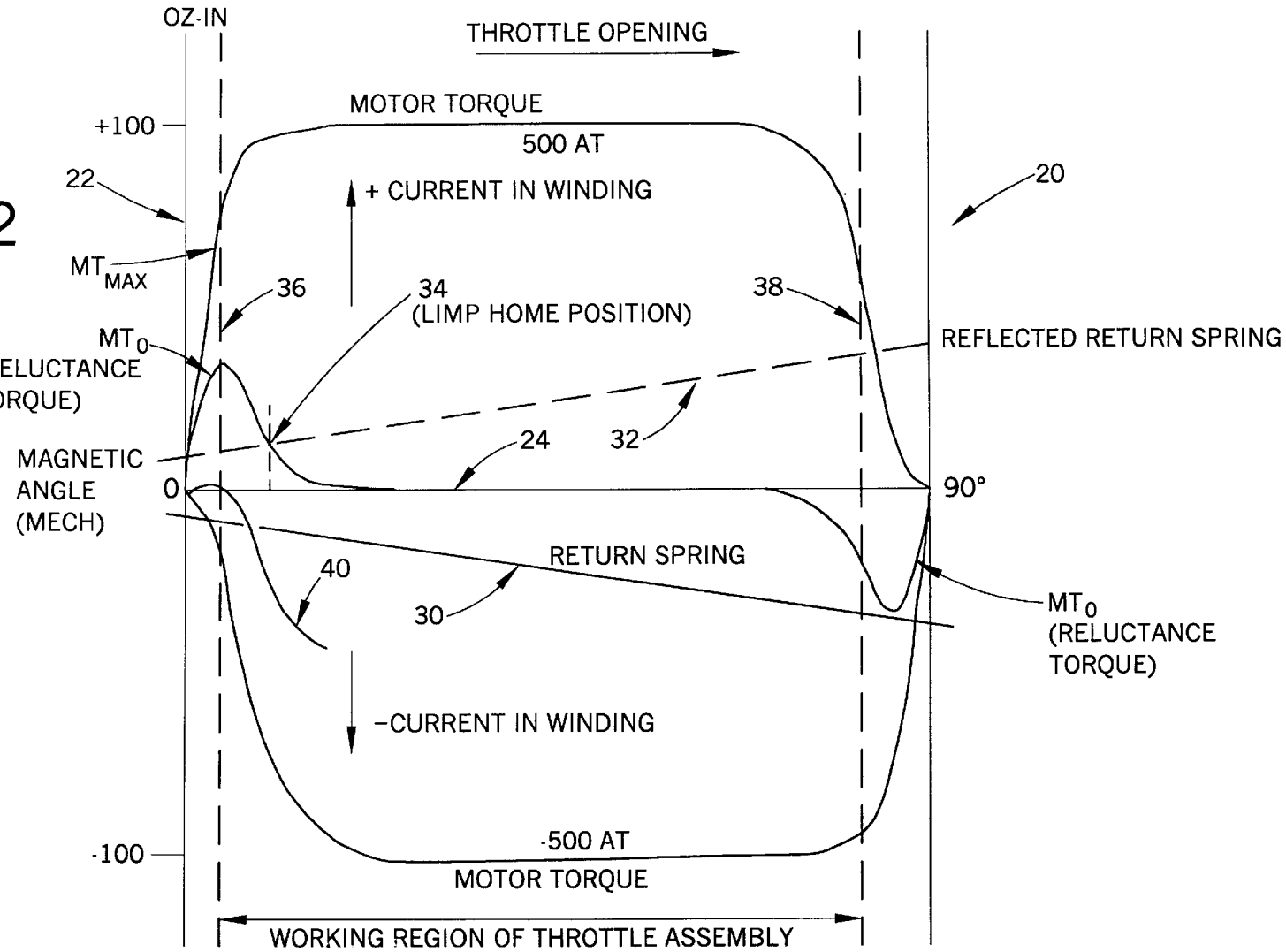
FIG. 2 is a graphical representation of torque variance measured against throttle position.

Referring now to FIG. 2, the graph 20 depicts torque on the vertical axis 22 and is measured in ounce 25-inches (oz-in). Throttle position on the horizontal axis 24 is depicted in terms of degrees of rotation of the throttle plate valve T. If a torque motor winding carries no current, the torque vs. position curve $MT_0$ is basically zero except at the extremities. This is called "reluctance torque" and is due to a large rate of change of stored energy as the pole tips of the torque motor begin to interact with the magnet transition from North to South. On the other hand, at maximum torque motor winding current, the torque vs. position curve $MT_{max}$ shows nearly uniform torque at all positions except the extremes.

Also shown in FIG. 2, is a return spring torque curve 30. The negative reflected return spring curve 32 shows a point of intersection with the reluctance torque curve $MT_0$. This point of intersection is the "limp home" position 34. The return effect will be enhanced by throttle shaft offset if used. Hence, ignoring friction, those of ordinary skill in the art will recognize that the throttle T will remain at the limp home position 34 if there is no current in the coils. Airflow may slightly urge the throttle T toward the throttle closed position 36, normally a mechanical stop.

The net effect is a self-regulating throttle valve T. If the engine speed increases, airflow through the manifold I increases and throttle offset will pull the position of the throttle T back, decreasing airflow, slowing the engine. If engine speed decreases, reduced airflow through manifold I will allow the throttle T to open under the force of the reluctance torque $MT_0$, thus increasing engine speed. Those skilled in the art will recognize that the present development defines a self-regulating system for controlling the position of the throttle plate valve T when electrical power to the motor 10 is lost.

With continuing reference to FIG. 2, position 38 defines a fully open position for the throttle valve T. Accordingly, the throttle valve is movable between the first and second positions 36, 38 which are each defined by mechanical stops to prevent movement of the throttle plate T therepast.

Normal operation with positive current generates additional torque $MT_{max}$ over the reluctance torque $MT_0$.

Hence, the throttle plate T mechanism will open. Or, in other words, the throttle plate will move along the throttle position axis 24 away from the closed position 36 toward the fully open position 38. The effective motor torque on the throttle plate can be seen as the difference between the positive motor torque (e.g. $MT_{max}$) and the reflected return spring curve 32.

Idle speed below the limp home position 34 is achieved by passing negative current through the windings of the torque motor 10 to pull the throttle T toward the closed position 36 overcoming the reluctance torque $MT_0$ "hill." Gradual increase in the magnitude of the negative current will generate a torque that will pull the throttle plate mechanism T against the stop 36.

Curve 40 depicts a torque applied to the throttle plate T in response to a negative current passed through the windings of the motor. As is evident, the negative current is required to completely close the throttle T overcoming reluctance torque $MT_0$. In the absence of negative electrical current to completely close the throttle T, the operator will have to engage other means of stopping the vehicle when it is safe to stop, for instance, a wheel brake assembly, or a change of transmission gearing.

While the invention has been described with respect to the illustrated embodiments, it will be understood that the invention is capable of modification and variation and is limited only by the following claims.

Having thus described the preferred embodiments, the invention is now claimed to be:

1. A method of ensuring continued airflow to an engine controlled by an electronic throttle system during a time of electrical power loss to the throttle system, the method comprising:

(a) positioning a throttle plate within an air/fuel intake manifold of the engine so that the throttle plate is movable between an open position allowing airflow through the manifold and a closed position substantially blocking airflow through the manifold;

(b) applying a first electromagnetic reluctance torque to the throttle plate to urge the throttle plate toward the open position, said electromagnetic reluctance torque being produced by electromagnetic properties of an associated torque motor; and (c) applying a second torque to the throttle plate to urge the throttle plate toward the closed position, wherein the first electromagnetic reluctance torque and the second torque counteract each other so that the throttle plate remains at a position between the open and closed positions to allow airflow through the manifold.

2. The method of ensuring continued airflow to an engine as set forth in claim 1 where step (b) comprises:

attaching a torque motor to the throttle plate, the motor electromagnetically defining a reluctance torque to urge the throttle plate toward the open position.

3. The method of ensuring continued airflow to an engine as set forth in claim 2 where step (c) comprises:

attaching a return spring to the throttle plate, where the return spring has a closing bias tending to place the throttle plate in the closed position.

4. The method of ensuring continued airflow to an engine as set forth in claim 3 further comprising:

determining a reluctance torque curve of the torque motor, the reluctance torque curve being an ordered set of specific no-current torque values plotted against a range of positions of the throttle plate; and angularly aligning the throttle plate such that the reluctance torque value for a desired position cancels the closing bias of the return spring at the desired position where the throttle plate is sufficiently open to allow airflow through the manifold.

5. A method of configuring an electromagnetic throttle assembly to operate in a degraded mode without electrical power comprising:

(a) applying an electromagnetic reluctance opening torque to a throttle plate tending to urge the throttle plate to an open position allowing airflow through a manifold, said electromagnetic reluctance torque being produced by electromagnetic properties of an associated torque motor; and (b) simultaneously applying a closing torque to the throttle plate tending to urge the throttle plate to a closed position impeding airflow such that the simultaneous application of the electromagnetic reluctance opening torque and the closing torque leaves the throttle plate in a neutral, slightly open position.

6. The method of configuring an electronic throttle assembly to operate in a degraded mode without electrical power as set forth in claim 5 where step (a) comprises:

connecting the throttle plate to a rotating portion of an electromagnetic torque motor defining a plurality of reluctance torque values based on the relative position of the rotating portion; and placing the throttle plate in an offset position where the reluctance torque supplies the opening torque.

7. The method of configuring an electronic throttle assembly to operate in a degraded mode without electrical power as set forth in claim 5 where step (b) comprises:

connecting the throttle plate to a return spring defining a plurality of closing torque values based on the position of the throttle plate;

placing the throttle plate in an offset position where the return spring supplies the closing torque.

8. An electronic throttle comprising:

a throttle plate movably disposed within an air/fuel intake manifold between a first position substantially blocking airflow and a second position substantially permitting airflow;

a torque motor defining a variable first electromagnetic reluctance torque urging the throttle plate toward the second position when no electrical current passes through windings of the torque motor, said electromagnetic reluctance force being provided by electromagnetic properties of an associated motor;

means for providing a second torque urging the throttle plate toward the first position; and a shaft operatively connecting the torque motor to the throttle plate, the shaft subject to the opposing first and second torques and angularly aligned such that the throttle plate rests in an equilibrium between the first and second positions.

9. The electronic throttle as set forth in claim 8 where the means for providing the second torque is a return spring.

* * * * *